US007606652B2

(12) United States Patent
Kaiser et al.

(10) Patent No.: US 7,606,652 B2
(45) Date of Patent: Oct. 20, 2009

(54) TORQUE BASED CRANK CONTROL

(75) Inventors: Jeffrey M. Kaiser, Highland, MI (US); Michael Livshiz, Ann Arbor, MI (US); Christopher E. Whitney, Highland, MI (US)

(73) Assignee: GM Global Technology Operations, Inc.

( * ) Notice: Subject to any disclaimer, the term of this patent is extended or adjusted under 35 U.S.C. 154(b) by 0 days.

(21) Appl. No.: 12/015,016

(22) Filed: Jan. 16, 2008

(65) Prior Publication Data

US 2009/0118967 A1 May 7, 2009

Related U.S. Application Data

(60) Provisional application No. 60/984,904, filed on Nov. 2, 2007.

(51) Int. Cl.
*G06G 7/70* (2006.01)

(52) U.S. Cl. ..... 701/102; 701/103; 701/110; 701/115

(58) Field of Classification Search ... 123/90.15–90.18, 123/399, 478; 701/103, 104, 102, 110, 115; 903/905, 906; 180/65.21, 65.265, 67.16
See application file for complete search history.

(56) References Cited

U.S. PATENT DOCUMENTS 6,308,671 B1 * 10/2001 Reed et al. ..... 123/90.15
6,704,638 B2 3/2004 Livshiz
2009/0024263 A1 * 1/2009 Simon et al. ..... 701/22

OTHER PUBLICATIONS

U.S. Appl. No. 11/737,190, filed Apr. 19, 2007, Livshiz.

* cited by examiner

*Primary Examiner*—Stephen K Cronin
*Assistant Examiner*—Keith Coleman
(74) *Attorney, Agent, or Firm*—Harness, Dickey & Pierce, P.L.C.

(57) ABSTRACT

A control system and method of regulating operation of an engine includes a minimum torque module that determines a torque request based upon at least two of measured revolutions per minute (RPM) of an engine, a barometric pressure, and a coolant temperature of the engine. A first engine air module can determine a first desired engine air value based upon predetermined actuator values and a torque value based upon the torque request. The predetermined actuator values can include a predetermined RPM of the engine. A throttle area module can determine a desired throttle area based upon the first desired engine air value and the predetermined RPM.

20 Claims, 3 Drawing Sheets

TORQUE BASED CRANK CONTROL

CROSS-REFERENCE TO RELATED APPLICATIONS

This application claims the benefit of U.S. Provisional Application No. 60/984,904, filed on Nov. 2, 2007. The disclosure of the above application is incorporated herein by reference.

FIELD

The present invention relates to engines, and more particularly to torque-based control of an engine.

BACKGROUND

Internal combustion engines combust an air and fuel mixture within cylinders to drive pistons, which produces drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders. As can be appreciated, increasing the air and fuel to the cylinders increases the torque output of the engine.

Engine control systems have been developed to accurately control engine speed output to achieve a desired engine speed. Traditional engine control systems, however, do not control the engine speed as accurately as desired. Further, traditional engine control systems do not provide as rapid of a response to control signals as is desired or coordinate engine torque control among various devices that affect engine torque output.

SUMMARY

Accordingly, the present disclosure provides a control system and method of regulating operation of an engine. The control system can include a minimum torque module that determines a torque request based upon at least two of a measured revolutions per minute (RPM) of an engine, a barometric pressure, and a coolant temperature of the engine. A first engine air module can determine a first desired engine air value based upon predetermined actuator values and a torque value based upon the torque request. The predetermined actuator values can include a predetermined RPM of the engine. A throttle area module can determine a desired throttle area based upon the first desired engine air value and the predetermined RPM.

According to additional features, the first desired engine air value can include a manifold pressure of the engine. The first desired engine air value can comprise one of an air per cylinder of the engine and a mass air flow of the engine.

A second engine air module can determine a second desired engine air value based upon the predetermined actuator values and the torque value. The throttle area module can determine the desired throttle area based upon the first and second desired engine air values and the predetermined RPM. The first and second desired engine air values can comprise a manifold pressure and an air flow, respectively.

A hybrid optimization module can generate the torque value based upon the torque request and generate an electric motor torque value based upon the torque request. A sum of the torque value and the electric motor torque value can be approximately equal to the torque request. The hybrid optimization module can generate the torque value based upon the torque request and an estimated torque.

A torque estimation module can generate the estimated torque based upon an estimated engine air value. The estimated engine air value can be an estimated air per cylinder. A phaser control module can determine a position of at least one of an intake cam phaser and an exhaust cam phaser based upon the measured RPM and the desired throttle area.

The method of regulating operation of the engine can include determining a torque request based upon at least two of a measured revolutions per minute (RPM) of an engine, a barometric pressure, and a coolant temperature of the engine. A first desired engine air value can be determined based upon predetermined actuator values and a torque value based upon the torque request. The predetermined actuator values can include a predetermined RPM. A desired throttle area can be determined based upon the first desired engine air value and the predetermined RPM.

According to additional features, the first desired engine air value can comprise a manifold pressure of the engine. According to still other features, the first desired engine air value can comprise one of an air per cylinder of the engine and a mass air flow of the engine.

A second desired engine air value can be determined based upon the predetermined actuator values and the torque value. The throttle area module can determine the desired throttle area based upon the first and second desired engine air values and the predetermined RPM. The first and second desired engine air values can comprise a manifold pressure and an air flow, respectively.

The torque value can be generated based upon the torque request. An electric motor torque value can be generated based upon the torque request. A sum of the torque value and the electric motor torque value can be approximately equal to the torque request. The estimated torque can be generated based upon an estimated engine air value. The estimated engine air value can be an estimated air per cylinder. A position of at least one of an intake cam phaser and an exhaust cam phaser can be determined based upon the measured RPM and the desired throttle area.

Further advantages and areas of applicability of the present disclosure will become apparent from the detailed description provided hereinafter. It should be understood that the detailed description and specific examples, while indicating an embodiment of the disclosure, are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
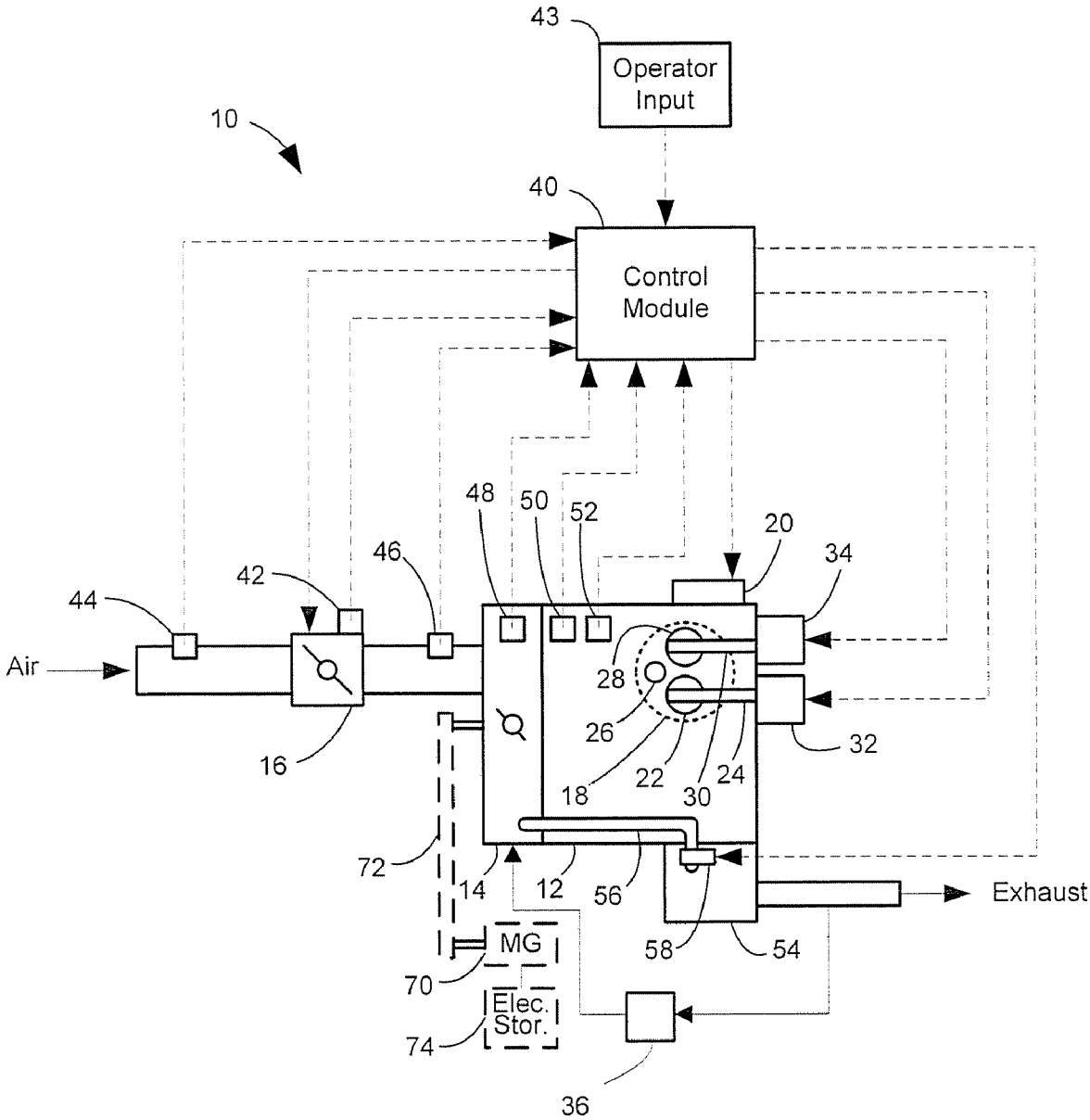
FIG. 1 is a schematic illustration of an exemplary engine system according to the present disclosure.

The following description is merely exemplary in nature and is in no way intended to limit the disclosure, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

Referring now to FIG. 1, an engine system 10 includes an engine 12 that combusts an air and fuel mixture to produce drive torque. Air is drawn into an intake manifold 14 through a throttle valve 16. The throttle valve 16 regulates mass air flow into the intake manifold 14. Air within the intake manifold 14 is distributed into cylinders 18. Although a single cylinder 18 is illustrated, it can be appreciated that the coordinated torque control system of the present invention can be implemented in engines having a plurality of cylinders including, but not limited to, 2, 3, 4, 5, 6, 8, 10 and 12 cylinders.

A fuel injector (not shown) injects fuel that is combined with the air as it is drawn into the cylinder 18 through an intake port. The fuel injector may be an injector associated with an electronic or mechanical fuel injection system 20, a jet or port of a carburetor or another system for mixing fuel with intake air. The fuel injector is controlled to provide a desired air-to-fuel (A/F) ratio within each cylinder 18.

An intake valve 22 selectively opens and closes to enable the air/fuel mixture to enter the cylinder 18. The intake valve position is regulated by an intake cam shaft 24. A piston (not shown) compresses the air/fuel mixture within the cylinder 18. A spark plug 26 initiates combustion of the air/fuel mixture, which drives the piston in the cylinder 18. The piston, in turn, drives a crankshaft (not shown) to produce drive torque. Combustion exhaust within the cylinder 18 is forced out an exhaust port when an exhaust valve 28 is in an open position. The exhaust valve position is regulated by an exhaust cam shaft 30. The exhaust is treated in an exhaust system and is released to atmosphere. Although single intake and exhaust valves 22, 28 are illustrated, it can be appreciated that the engine 12 can include multiple intake and exhaust valves 22, 28 per cylinder 18.

The engine system 10 can include an intake cam phaser 32 and an exhaust cam phaser 34 that respectively regulate the rotational timing of the intake and exhaust cam shafts 24, 30. More specifically, the timing or phase angle of the respective intake and exhaust cam shafts 24, 30 can be retarded or advanced with respect to each other or with respect to a location of the piston within the cylinder 18 or crankshaft position. In this manner, the position of the intake and exhaust valves 22, 28 can be regulated with respect to each other or with respect to a location of the piston within the cylinder 18. By regulating the position of the intake valve 22 and the exhaust valve 28, the quantity of air/fuel mixture ingested into the cylinder 18 and therefore the engine torque is regulated.

The engine system 10 can also include an exhaust gas recirculation (EGR) system 36. The EGR system 36 includes an EGR valve (not shown) that regulates exhaust flow back into the intake manifold 14. The EGR system is generally implemented to regulate emissions. However, the mass of exhaust air that is circulated back into the intake manifold 14 also affects engine torque output.

A control module 40 operates the engine 12 based on the torque-based engine control of the present disclosure. More specifically, the control module 40 generates a throttle control signal and a spark advance control signal. A throttle position signal is generated by a throttle position sensor (TPS) 42. An operator input 43, such as an accelerator pedal, generates an operator input signal. The control module 40 commands the throttle valve 16 to a steady-state position to achieve a desired throttle area ($A_{THRDES}$) and commands the spark timing to achieve a desired spark timing ($S_{DES}$) A throttle actuator (not shown) adjusts the throttle position based on the throttle control signal.

An intake air temperature (IAT) sensor 44 is responsive to a temperature of the intake air flow and generates an intake air temperature (IAT) signal. A mass airflow (MAF) sensor 46 is responsive to the mass of the intake air flow and generates a MAF signal. A manifold absolute pressure (MAP) sensor 48 is responsive to the pressure within the intake manifold 14 and generates a MAP signal. An engine coolant temperature sensor 50 is responsive to a coolant temperature and generates an engine temperature signal. An engine speed sensor 52 is responsive to a rotational speed (i.e., RPM) of the engine 12 and generates in an engine speed signal. Each of the signals generated by the sensors is received by the control module 40.

The engine system 10 can also include a turbo or supercharger 54 that is driven by the engine 12 or engine exhaust. The turbo 54 compresses air drawn in from the intake manifold 14. More particularly, air is drawn into an intermediate chamber of the turbo 54. The air in the intermediate chamber is drawn into a compressor (not shown) and is compressed therein. The compressed air flows back to the intake manifold 14 through a conduit 56 for combustion in the cylinders 18. A bypass valve 58 is disposed within the conduit 56 and regulates the flow of compressed air back into the intake manifold 14.

According to additional features the engine system 10 can have a hybrid powertrain (identified in phantom). A motor generator 70 can be coupled to the engine 12 using a drive 72 such as a belt drive, a chain drive, a clutch system or any other device. The motor generator 70 can be powered by an electric storage device 74. The vehicle can be driven forward either by the engine 12, the motor generator 70 or a combination of both.

Figure 2:
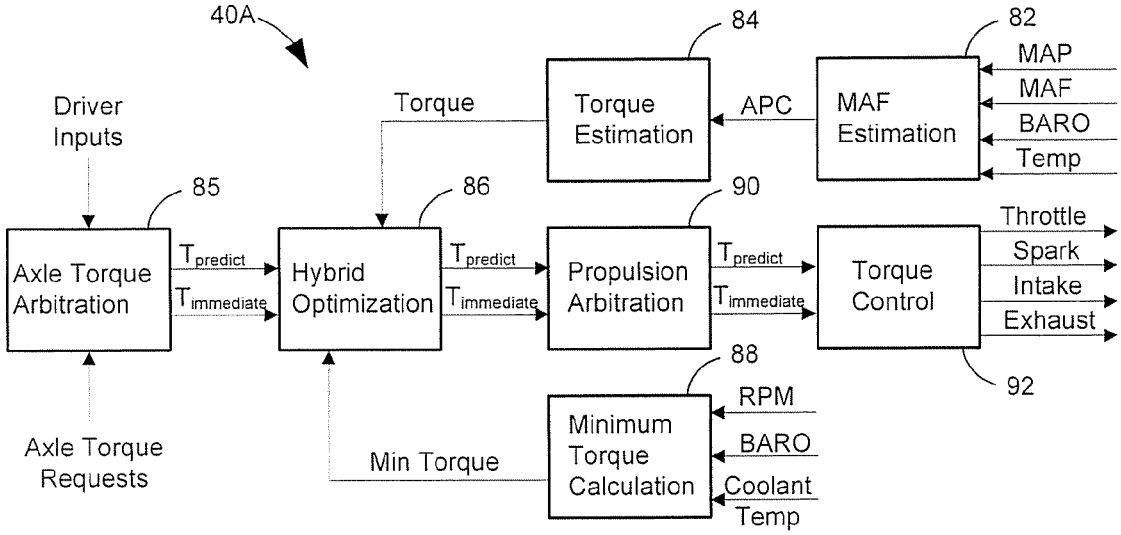
FIG. 2 is a block diagram illustrating modules that execute the torque-based control of the present disclosure for a vehicle having a hybrid powertrain.

With reference to FIG. 2, a torque based control module for a hybrid vehicle according to the present teachings is shown and generally identified at reference 40A. The control module 40A can include a MAF estimation module 82, a torque estimation module 84, an axle torque arbitration module 85, a hybrid optimization module 86, a minimum torque calculation module 88, a propulsion arbitration module 90, and a torque control module 92.

The MAF estimation module 82 can determine an estimated air-per-cylinder ($APC_{EST}$) of the engine 12 based on the measured or actual MAP ($MAP_{ACT}$), the MAF signal, the barometric pressure, and the ambient temperature. More specifically, a MAP-based torque model is implemented to determine a MAP-based torque ($T_{MAP}$) and is described in the following relationship:

$$T_{MAP}=(a_{p1}((\mathrm{RPM},I,E,S)*\mathrm{MAP}_{ACT}+a_{p0}(\mathrm{RPM},I,E,S)+a_{P2}(\mathrm{RPM},I,E,S)*B))*\eta(\mathrm{IAT}) \quad (1)$$

where:

S is the spark timing;

I is the intake cam phase angle;

E is the exhaust cam phase angle;

B is the barometric pressure; and $\eta$ is a thermal efficiency factor that is determined based on IAT.

The coefficients $a_P$ are predetermined values. An APC-based torque model can be used to determine an APC-based torque ($T_{APC}$) and is described in the following relationship:

$$T_{APC}=a_{A1}(\text{RPM},I,E,S)*\text{APC}+a_{A0}(\text{RPM},I,E,S) \quad (2)$$

The coefficients $a_A$ are predetermined values. Because $T_{MAP}$ is equal to $T_{APC}$, the APC-based torque model can be inverted to calculate $APC_{EST}$ based on $MAP_{ACT}$, in accordance with the following relationship:

$$APC_{EST} = \frac{a_{p1} * \eta * MAP_{ACT} + (a_{p0} + a_{p2} * B) * \eta - a_{A0}}{a_{A1}} \quad (3)$$

If the engine 12 is operating at steady-state, $APC_{EST}$ is corrected based on a measured or actual APC ($APC_{ACT}$) to provide a corrected $APC_{EST}$. $APC_{EST}$ is corrected in accordance with the following relationship:

$$APC_{EST}=APC_{EST}+k_1*\int(APC_{EST}=APC_{ACT})dt \quad (4)$$

$k_1$ is a pre-determined corrector coefficient. $MAP_{ACT}$ is monitored to determine whether the engine 12 is operating at steady-state. For example, if the difference between a current $MAP_{ACT}$ and a previously recorded $MAP_{ACT}$ is less than a threshold difference, the engine 12 is operating at steady-state. VE is subsequently determined based on APCEST in accordance with the following relationship:

$$VE = \frac{APC_{EST}}{MAP_{ACT} * k(IAT)} \quad (5)$$

k is a coefficient that is determined based on IAT using, for example, a pre-stored look-up table. Additional details of one suitable MAF estimation module may be found in co-owned and co-pending U.S. application Ser. No. 11/737,190, filed on Apr. 19, 2007, which is incorporated by reference in its entirety. The $APC_{EST}$ can then be output to the torque estimation module 84.

Figure 4:
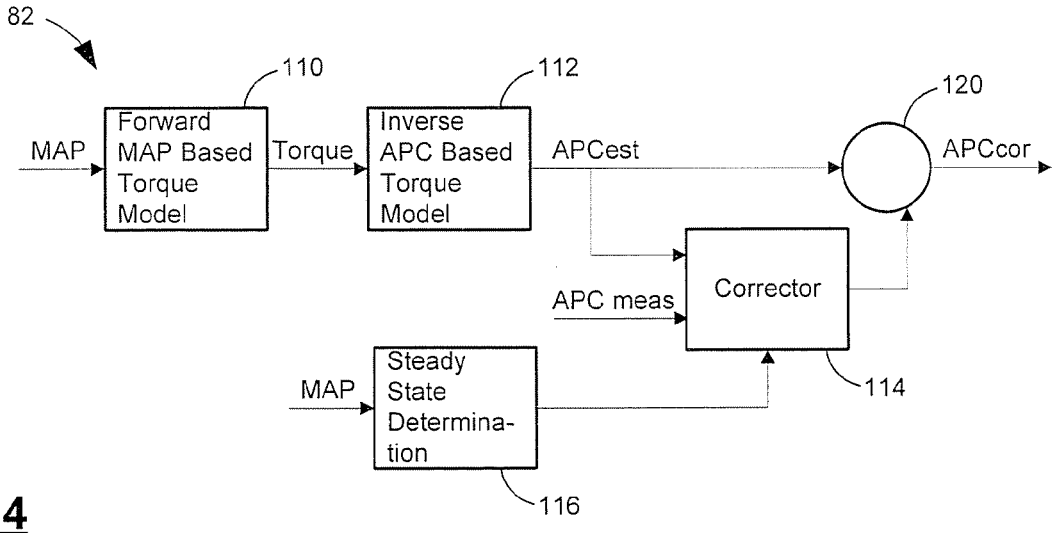
FIG. 4 is a block diagram illustrating exemplary modules of the torque estimation module of FIG. 2.

Referring now to FIG. 4, exemplary modules that execute MAF estimation 82 will be described in detail. The exemplary modules include a MAP-based torque model module 110, an inverse APC-based torque model module 112, a corrector module 114, a steady-state determining module 116, and a summer module 120. The MAP-based torque model module 110 determines $T_{MAP}$ using the MAP-based torque model described above. The inverse APC-based torque model module 112 determines $APC_{EST}$ based on a torque output from the MAP-based torque model module 110.

The corrector module 114 determines $APC_{CORR}$ based on $APC_{EST}$, $APC_{ACT}$ and a signal from the steady-state determining module 116. More specifically, the steady-state determining module 116 determines whether the engine 12 is operating in steady-state based on $MAP_{ACT}$. If the engine 12 is operating in steady-state, a correction factor is output by the corrector module 114. If the engine 12 is not operating in steady-state, the correction factor is set equal to zero. The summer module 120 sums $APC_{EST}$ and the correction factor to provide a corrected $APC_{EST}$. In various implementations, the corrector module 114 is not used. The APC is input into the torque estimation module 84 (FIG. 2).

The torque-based APC determination control enables an APC value to be determined from a known data set. The data set is generated during the course of engine development using a tool such as DYNA-AIR. Because these values can be determined from known values, the amount of dynamometer time is reduced, because the APC value does not need to be determined while the engine 12 is running on a dynamometer during engine development. This contributes to reducing the overall time and cost of engine development. Furthermore, the torque-based APC determination control provides an automated process for estimating the APC values.

The torque estimation module 84 determines an estimated torque being produced based on the APC output from the MAF estimation module 82. A detailed description of the torque estimation module 84 may be found in co-owned U.S. Pat. No. 6,704,638 which is incorporated by reference in its entirety.

The minimum torque calculation module 88 determines a minimum torque needed to activate the engine 12 based on an engine RPM, a barometric pressure and coolant temperature. In one example, the engine RPM can be 550 RPM if at idle operating speed. Other values are contemplated.

The axle torque arbitration module 85 arbitrates between driver inputs and other axle torque requests. For example, driver inputs may include accelerator pedal position. Other axle torque requests may include torque reduction requested during a gear shift by a transmission control module, torque reduction requested during wheel slip by a traction control system, and torque requests to control speed from a cruise control system.

The axle torque arbitration module 85 outputs a predicted torque and an immediate torque. The predicted torque is the amount of torque that will be required in the future to meet the driver's torque and/or speed requests. The immediate torque is the torque required at the present moment to meet temporary torque requests, such as torque reductions when shifting gears or when traction control senses wheel slippage.

The immediate torque may be achieved by engine actuators that respond quickly, while slower engine actuators are targeted to achieve the predicted torque. For example, a spark actuator may be able to quickly change spark advance, while cam phaser or throttle actuators may be slower to respond. The axle torque arbitration module 85 outputs the predicted torque and the immediate torque to the hybrid optimization module 86.

The hybrid optimization module 86 determines how much torque should be produced by the engine 12 and how much torque should be produced by the electric motor generator 70 based on the estimated torque output by the torque estimation module 84, the predicted and immediate torque output by the axle torque arbitration module 85, and the minimum torque output by the minimum torque calculation module 88. The hybrid optimization module 86 then outputs modified predicted and immediate torque values to the propulsion arbitration module 90.

The propulsion arbitration module 90 arbitrates between the predicted and immediate torque and propulsion torque requests. Propulsion torque requests may include torque reductions for engine over-speed protection and torque increases for stall prevention. The torque control module 92 receives the predicted torque and the immediate torque from the propulsion arbitration module 90.

Figure 3:
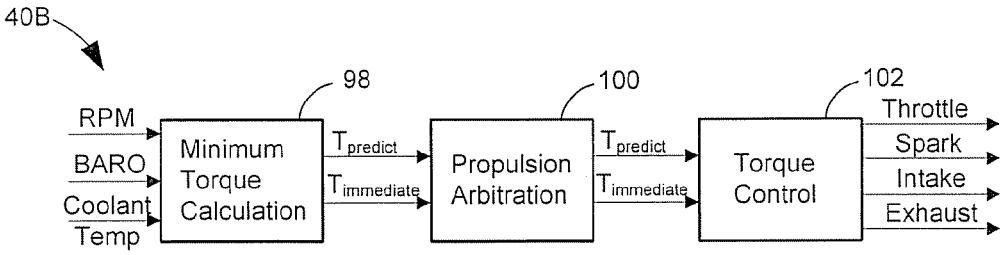
FIG. 3 is a block diagram illustrating modules that execute the torque-based control of the present disclosure for a vehicle having an internal combustion engine powertrain.

With reference to FIG. 3, a torque based control system for a vehicle powered solely by an internal combustion engine according to the present teachings is shown and generally identified at reference 40B. The control module 40B can include a minimum torque calculation module 98, a propulsion arbitration module 100, and a torque control module 102. The operation of the torque based control module 40B is substantially similar to the torque based control module 40A described above, but because the powertrain does not have an electric motor, the minimum torque calculation module 98 outputs a predicted torque and an immediate torque to the propulsion arbitration module 100.

Figure 5:
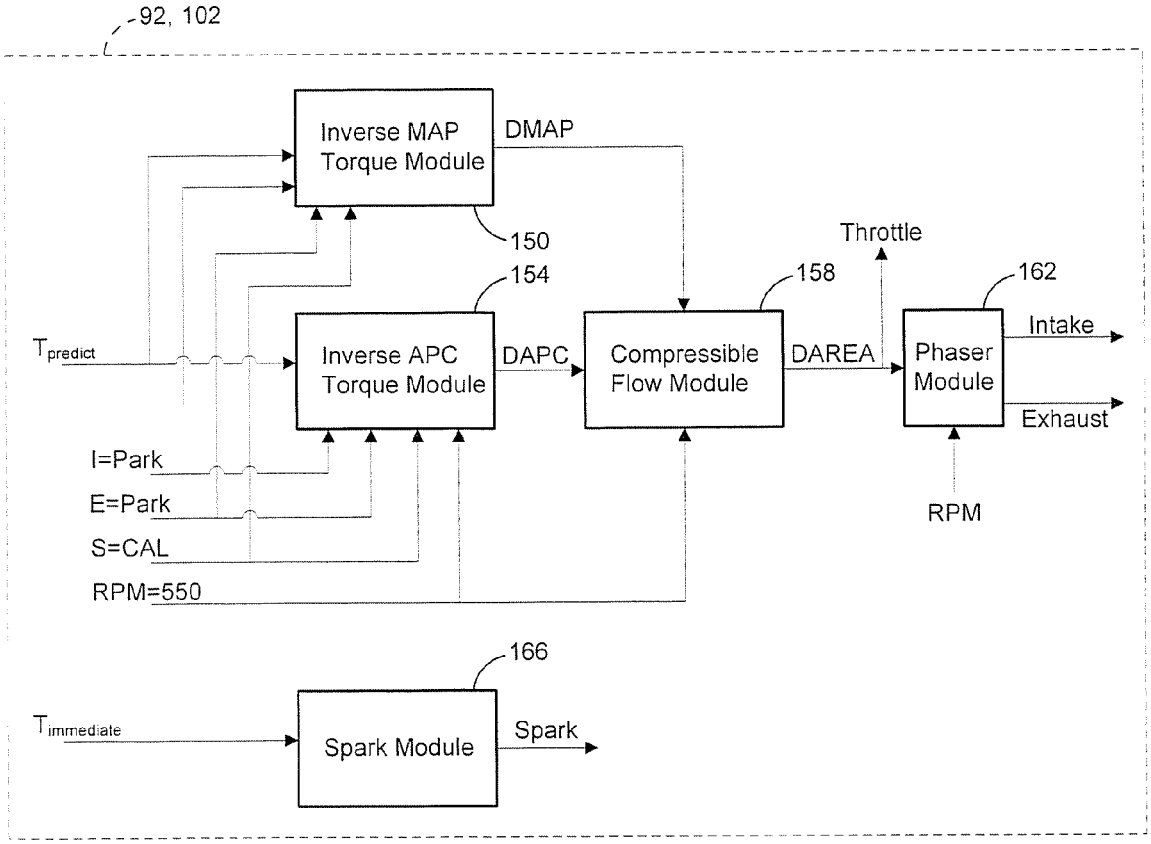
FIG. 5 is a block diagram illustrating exemplary modules of the torque control module of FIGS. 2 and 3.

Turning now to FIG. 5, the torque control module 92 (FIG. 2) and 102 (FIG. 3) will be described in greater detail. The torque control modules 92 and 102 can include an inverse MAP torque module 150, an inverse APC torque module 154, a compressible flow (throttle area) module 158, a phaser scheduling and actuation module 162, and a spark actuator module 166.

The propulsion arbitration module 90 outputs the predicted torque to the inverse MAP torque module 150 and the inverse APC torque module 154. The propulsion arbitration module 90 also outputs the immediate torque to the spark actuator module 166. Various predetermined actuator inputs such as spark advance (S), intake (I), exhaust (E), and RPM are input into the inverse MAP torque module 150 and to the inverse APC torque module 154. Notably these actuator inputs can be predefined based on a calibration rather than measured values.

The inverse APC module 154 may use calculations to determine APC based upon the desired torque and the predetermined actuator inputs. The inverse APC module 154 may implement a torque model that estimates torque based on the predetermined actuator inputs such as S, I, E, and RPM. Other predetermined actuator inputs can be used and include air/fuel ratio (AF), oil temperature (OT) and a number of cylinders currently being fueled (#). If the desired torque $T_{des}$ is assumed to be the torque model output, and the received actuator positions are substituted, the inverse APC module 154 can solve the torque model for the only unknown, APC. This inverse use of the torque model may be represented as follows:

$$\mathrm{APC}_{des}=T_{apc}^{-1}(T_{des},S,I,E,\mathrm{RPM}). \tag{7}$$

The inverse APC module 154 outputs the calculated APC to a compressible flow module 158. The inverse MAP module 150 determines a desired MAP based on the desired torque from the propulsion arbitration module 90 and the predetermined actuator inputs. The desired MAP may be determined by the following equation:

$$\mathrm{MAP}_{des}=T_{map}^{-1}((T_{des}+f(\mathrm{delta_}T)),\mathrm{RPM},S,I,E,AF,OT,\#) \tag{8}$$

where f(delta_T) is a filtered difference between MAP-based and APC-based torque estimators. The inverse MAP module 150 outputs the desired MAP to the compressible flow module 158.

The compressible flow module 158 determines a desired throttle area based on the desired MAF (which is proportional to desired APC) and the desired MAP. The desired area may be calculated using the following equation:

$$Area_{des}=\frac{MAF_{des}\cdot\sqrt{R_{gas}\cdot T}}{P_{baro}\cdot\Phi(P_r)},\ \text{where}\ P_r=\frac{MAP_{des}}{P_{baro}}, \tag{9}$$

and where $R_{gas}$ is the ideal gas constant, T is intake air temperature, and $P_{baro}$ is barometric pressure. $P_{baro}$ may be directly measured using a sensor, such as the IAT sensor 44, or may be calculated using other measured or estimated parameters.

The ϕ function may account for changes in airflow due to pressure differences on either side of the throttle valve 16. The ϕ function may be specified as follows:

$$\Phi(P_r)=\begin{cases}\sqrt{\frac{2\gamma}{\gamma-1}\left(1-P_r^{\frac{\gamma-1}{\gamma}}\right)} & \text{if } P_r>P_{critical}\\ \sqrt{\gamma\left(\frac{2}{\gamma+1}\right)^{\frac{\gamma+1}{\gamma-1}}} & \text{if } P_r\le P_{critical}\end{cases},\ \text{where} \tag{10}$$

$$P_{critical}=\left(\frac{2}{\gamma+1}\right)^{\frac{\gamma}{\gamma-1}}=0.528\ \text{for air}, \tag{11}$$

and where γ is a specific heat constant that is between approximately 1.3 and 1.4 for air. $P_{critical}$ is defined as the pressure ratio at which the velocity of the air flowing past the throttle valve 16 equals the velocity of sound, which is referred to as choked or critical flow. The compressible flow module 158 outputs the desired area to the throttle valve 16 to provide the desired opening area and to the phaser scheduling and actuation module 162.

Based on the desired area and the RPM signal, the phaser scheduling and actuation module 162 commands the intake and/or exhaust cam phasers 32 and 34 to calibrated values. Based upon the immediate torque output from the propulsion arbitration module 90, the spark actuator module 166 energizes a spark plug 26 in the cylinder 18, which ignites the air/fuel mixture. The timing of the spark may be specified relative to the time when the piston is at its topmost position, referred to as to top dead center (TDC), the point at which the air/fuel mixture is most compressed.

Figure 6:
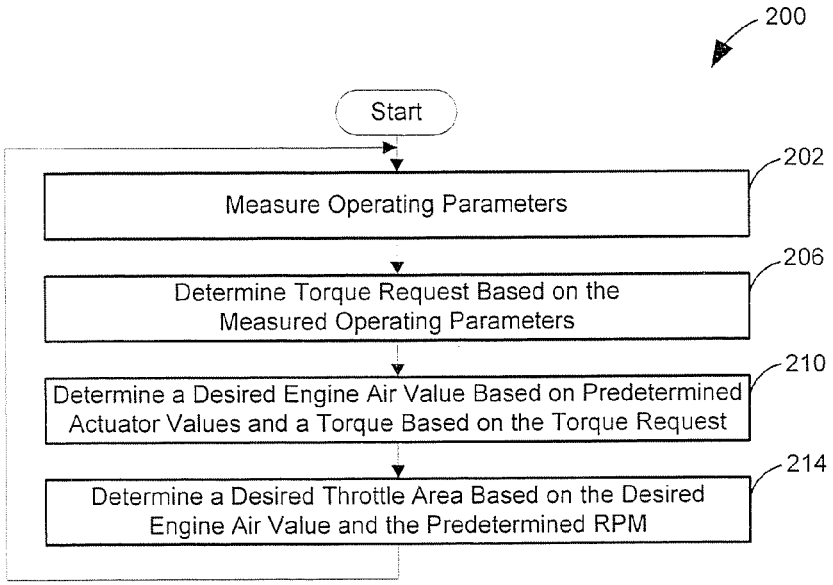
FIG. 6 is a flowchart illustrating steps executed by the torque-based crank control of the present disclosure.

Referring now to FIG. 6, a flowchart depicts exemplary steps performed by the predicted torque control modules 40A or 40B. Control begins in step 202, where the engine operating parameters are measured. Control continues in step 206, where control determines a torque request based on the measured operating parameters. Control continues in step 210 where control determines a desired engine air value based on predetermined actuator values and a torque based on the torque request. Control continues in step 214 where control determines a desired throttle area based on the desired engine air value and the predetermined RPM. Control then loops to step 202.

Those skilled in the art can now appreciate from the foregoing description that the broad teachings of the present disclosure can be implemented in a variety of forms. Therefore, while this disclosure has been described in connection with particular examples thereof, the true scope of the disclosure should not be so limited since other modifications will become apparent to the skilled practitioner upon a study of the drawings, the specification and the following claims.

What is claimed is:

1. An engine control system comprising:

a minimum torque module that determines a torque request based upon at least two of measured revolutions per minute (RPM) of an engine, a barometric pressure, and a coolant temperature of the engine;

a hybrid optimization module that generates a torque value based upon said torque request and that generates an electric motor torque value based upon said torque request;

a first engine air module that determines a first desired engine air value based upon predetermined actuator values, said torque value and said torque request, wherein said predetermined actuator values include a predetermined RPM of the engine; and a throttle area module that determines a desired throttle area based upon said first desired engine air value and said predetermined RPM.

2. The engine control system of claim 1 wherein said first desired engine air value comprises a manifold pressure of the engine.

3. The engine control system of claim 1 wherein said first desired engine air value comprises one of an air per cylinder of the engine and a mass air flow of the engine.

4. The engine control system of claim 1 further comprising a second engine air module that determines a second desired engine air value based upon said predetermined actuator values and said torque value, wherein said throttle area module determines said desired throttle area based upon said first and second desired engine air values and said predetermined RPM, wherein said first and second desired engine air values comprise a manifold pressure and an air flow, respectively.

5. The engine control system of claim 1 wherein a sum of said torque value and said electric motor torque value is approximately equal to said torque request.

6. The engine control system of claim 1 wherein said hybrid optimization module generates said torque value based upon said torque request and an estimated torque.

7. The engine control system of claim 6 further comprising a torque estimation module that generates said estimated torque based upon an estimated engine air value.

8. The engine control system of claim 7 wherein said estimated engine air value is an estimated air per cylinder.

9. The engine control system of claim 1 further comprising a phaser control module that determines a position of at least one of an intake cam phaser and an exhaust cam phaser based upon said measured RPM and said desired throttle area.

10. A method of controlling an engine comprising:

determining a torque request based upon at least two of measured revolutions per minute (RPM) of an engine, a barometric pressure, and a coolant temperature of the engine;

generating a torque value based upon a torque request and generating an electric motor torque value based upon said torque request;

determining a first desired engine air value based upon predetermined actuator values, said torque value and said torque request, wherein said predetermined actuator values include a predetermined RPM of the engine; and determining a desired throttle area based upon said first desired engine air value and said predetermined RPM.

11. The method of claim 10 wherein said first desired engine air value comprises a manifold pressure of the engine.

12. The method of claim 10 wherein said first desired engine air value comprises one of an air per cylinder of the engine and a mass air flow of the engine.

13. The method of claim 10, further comprising determining a second desired engine air value based upon said predetermined actuator values and said torque value, wherein said throttle area module determines said desired throttle area based upon said first and second desired engine air values and said predetermined RPM, wherein said first and second desired engine air values comprise a manifold pressure and an air flow, respectively.

14. The method of claim 10 wherein a sum of said torque value and said electric motor torque value is approximately equal to said torque request.

15. The method of claim 10 wherein said torque value is generated based upon said torque request and an estimated torque.

16. The method of claim 15 further comprising generating said estimated torque based upon an estimated engine air value.

17. The method of claim 16 wherein said estimated engine air value is an estimated air per cylinder.

18. The method of claim 10 further comprising determining a position of at least one of an intake cam phaser and an exhaust cam phaser based upon said measured RPM and said desired throttle area.

19. An engine control system comprising:

a minimum torque module that determines a torque request based upon at least one of measured revolutions per minute (RPM) of an engine, a barometric pressure, and a coolant temperature of the engine;

a hybrid optimization module that generates a torque value based upon said torque request and that generates an electric motor torque value based upon said torque request;

a first engine air module that determines a first desired engine air value based upon a predetermined RPM of the engine and said torque value based upon said torque request; and a throttle area module that determines a desired throttle area based upon said first desired engine air value and said predetermined RPM.

20. The engine control system of claim 19 further comprising a second engine air module that determines a second desired engine air value based upon said predetermined actuator values and said torque value, wherein said throttle area module determines said desired throttle area based upon said first and second desired engine air values and said predetermined RPM, wherein said first and second desired engine air values comprise a manifold pressure and an air flow, respectively.

* * * * *